United States Patent [19]

Decker et al.

[11] 4,042,492

[45] Aug. 16, 1977

[54] APPARATUS FOR THE SEPARATION OF MAGNETIZABLE PARTICLES FROM A FINE GRANULAR SOLID

[75] Inventors: Hanns Decker, Cologne-Rath; Roland Pfeiffer, Bensberg-Frankenforst; Lothar Wenz, Cologne; Horst Cordes, Troisdorf-Eschmar, all of Germany

[73] Assignee: Klockner-Humboldt-Deutz Aktiengesellschaft, Germany

[21] Appl. No.: 646,585

[22] Filed: Jan. 5, 1976

Related U.S. Application Data

[63] Continuation of Ser. No. 461,723, April 17, 1974, abandoned.

[30] Foreign Application Priority Data

Apr. 27, 1973 Germany ..... 2321281

[51] Int. Cl.[2] ..... B03C 1/14

[52] U.S. Cl. ..... 209/223 R; 209/229; 209/232

[58] Field of Search ..... 209/223 R, 232, 214, 209/230, 231; 210/222, 223, 229

[56] References Cited

U.S. PATENT DOCUMENTS

| | | | |
|---|---|---|---|
| 422,732 | 3/1890 | Conkling | 209/223 R |
| 453,317 | 6/1891 | Townsend | 210/222 X |
| 2,056,426 | 10/1936 | Flantz | 209/232 |
| 2,564,515 | 8/1951 | Vogel | 209/232 X |
| 2,604,207 | 7/1952 | Scott | 209/232 X |
| 2,979,202 | 4/1961 | Orbeliani | 209/223 R |
| 3,006,472 | 10/1961 | Clute | 209/223 R |
| 3,289,836 | 12/1966 | Weston | 209/214 |
| 3,375,926 | 4/1968 | Watts | 209/223 R |
| 3,382,977 | 5/1968 | Fraas | 209/214 |
| 3,608,718 | 9/1971 | Aubrey | 209/214 |

FOREIGN PATENT DOCUMENTS

| | | | |
|---|---|---|---|
| 2,159,525 | 6/1972 | Germany | 209/223 |
| 362,124 | 12/1931 | United Kingdom | 209/230 |
| 633,373 | 12/1949 | United Kingdom | 209/232 |

*Primary Examiner*—Robert Halper
*Attorney, Agent, or Firm*—Hill, Gross, Simpson, Van Santen, Steadman, Chiara & Simpson

[57] ABSTRACT

A magnetic separator includes a channel, having a plurality of walls, one of which includes a vertically traveling conveyor belt; a magnetic coil is arranged on one channel wall for producing a high intensity magnetic field; inlet means is provided for introducing a carrier medium into the channel and an injecting means on a side channel wall opposite the magnetic coil and downstream of the inlet charges material into the medium. A doctoring member removes magnetic particles drawn to the conveyor belt and means spaced from said one wall removes non-magnetic particles and carrier medium.

1 Claim, 4 Drawing Figures

APPARATUS FOR THE SEPARATION OF MAGNETIZABLE PARTICLES FROM A FINE GRANULAR SOLID

This is a continuation, of application Ser. No. 461,723, filed Apr. 17, 1974, now abandoned.

BACKGROUND OF THE INVENTION

1. Field of the Invention

This invention relates to apparatus for the separation of magnetizable particles from a stream of material, particularly from a fine granular solid which is guided by a carrier medium in a channel through a magnetic field of high field intensity of at least 15,000 Gauss extending partially in the direction of the stream of the material.

2. Description of the Prior Art

A method and apparatus are described in the published German application No. 2,159,525 in which magnetizable particles are separated from a fine granular solid with the aid of a magnetic field produced by means of superconductive coils. In the case of this known method, however, the fine granular solid to be prepared is first suspended in a carrier medium and then distributed over the entire cross section of the carrier medium channels which extend through the magnetic field. This method has the disadvantage that, for example, upon the separation of magnetizable ore from its gangue, particles of gangue located in proximity to the wall do not permit of separation from the magnetizable particles, and then on the other hand, magnetizable particles located approximately in the center of the flow channel must move over the full width of the channel through the entire suspension stream. In this manner, in the known method, the sharpness of separation and the output is impaired to an appreciable degree.

In addition, as the discharge of the separated magnetizable particles is to take place solely through a partial stream of the carrier medium, a depositing of the magnetizable particles in the area of the separating zone on the channel wall cannot be prevented so that such particles adhere to the wall and so that during the course of the time the free flow cross-section of the channel decreases.

SUMMARY OF THE INVENTION

It is the primary object of the invention to provide apparatus for the separation of magnetizable particles out of the stream of material, particularly out of a finely granular solid, while preventing the disadvantages of the previously known method.

More specifically, it is the object of the invention to provide apparatus for the separation of magnetizable particles out of a stream of a finely granular solid through the utilization of a high magnetic field intensity of, for example, 15,000 Gauss, as advantageously may be produced through the utilization of superconducting coils. This separation is to be free of any difficulty in separating the magnetizable particles from the remainder of the stream of material, particularly from other solids and the carrier medium.

The foregoing takes place, according to the invention, in that the charging material is introduced into the channel in the form of a jet which is spaced from the wall of the channel in the area of the highest field strength and in that the magnetizable particles adhering to the channel wall in the area of a separating zone downstream of the charging point are removed from the channel.

Through the above procedure the magnetizable particles located in the charging material are removed, under the influence of the magnetic field, laterally out of the charging jet and without hindrance pass transversely through the additional accompanying solids solely from the areas filled by the carrier medium, while the non-magnetizable stream of material flows down together with the carrier medium without, however, mixing with the same to an appreciable extent, and, above all, without filling out the entire cross section of the channel which would result in a restriction of flow.

According to one feature of the invention it is provided that the charging material is introduced into the magnetic field with an inlet speed which is dependent on the field intensity and/or the magnetizability of the particles to be separated out. For this purpose, particularly with the utilization of superconducting coils, the technique permits the production of a magnetic field which extends substantially in the direction of the stream of the carrier medium, which field has practically only in the area of the coil ends, a field gradient for obtaining a separation which is free from impurities so that through the speed with which theparticles to be separated are guided through the non-homogeneous area of the magnetic field, even in the case of weakly magnetizable particles, a sufficiently great magnetic force acts on the particles.

In accordance with another feature of the invention it is also provided that the charging material is introduced into the carrier medium in the form of a thin, advantageously band-shaped jet upstream of the separating one in an area of low field intensity.

In this connection, it is especially advantageous if the form of the jet is so developed that its outer side facing the precipitation wall extends parallel to the precipitation wall so that the magnetizable particles to be separated from the charging jet must cover the same path length to the precipitation wall over the entire width of the jet. For this reason, it is also advantageous if the charging jet is very thin with respect to the direction of movement of the magnetizable particles, so that the movement of the magnetizable particles to the precipitation wall is not hindered as they pass through the additional accompanying solids.

In a further advantageous development of the invention a feature is provided wherein the charging jet is introduced inclined at an angle with respect to the direction of flow of the carrier medium in the direction of the magnetic field of increasing magnitude. Through the utilization of this technique a magnetic force become effective for improved separation. More specifically, it is attained that on the magnetizable particles to be divided out in the homogeneous field in itself, in the area of the charging zone, the magnetic force becomes effective for improved separation because of the deflection of the charging jet from the original direction through the stream of the carrier medium.

According to the invention a device for carrying out the method of the invention includes a channel surrounded, at least partially, by at least one magnetic coil. Advantageously, the channel extends vertically. According to the invention, a charging device is provided opening into the channel and spaced from the channel wall which is surrounded by the magnetic coil. Advantageously, in the homogeneous area of the magnetic field produced by the magnetic coil, a precipitation wall is provided in a separating zone downstream from the charging device for receiving the magnetizable particles. A discharging device for the magnetizable particles is provided in connection with the precipitation wall so that the separated magnetizable particles may be removed from the separation device.

According to a feature of the separation device, it is further provided that the precipitation wall be equipped with an intermittently actuated wiper. Such an embodiment is of particular advantage when, for example, upon the cleansing of liquids or of solids which are mixed with only small portions of magnetizable particles, a continuously operating discharge device would be too expensive on account of the low yield of magnetizable particles.

In accordance with a feature of a further development of the invention it is provided that the charging device is constructed as an ejector nozzle. With the structure of such an embodiment it is advantageously attained that the charging material is sucked up by the carrier medium flowing through the channel so that an expansion of the jet of charging material is prevented within the channels. In this manner, it is advantageous in the case of separation of magnetizable particles from solids, if the charging material is introduced into the stream of carrier medium already suspended in carrier medium.

For the simplification of feed of the charging material into the flow channel, it is of advantage if, according to a further embodiment of the invention, an additional magnetic coil is introduced or arranged in the area of material charging to provide a magnetic field for influencing the primary magnetic field so that in the area of the outlet of the charging device practically no magnetic gradient is present.

BRIEF DESCRIPTION OF THE DRAWINGS

The apparatus of the present invention, its organization, construction and operation, along with other objects, features and advantages of the invention, will be best understood from the following detailed description of embodiments of the invention taken in conjunction with the accompanying drawings, on which.

DESCRIPTION OF THE PREFERRED EMBODIMENTS

Figure 1:
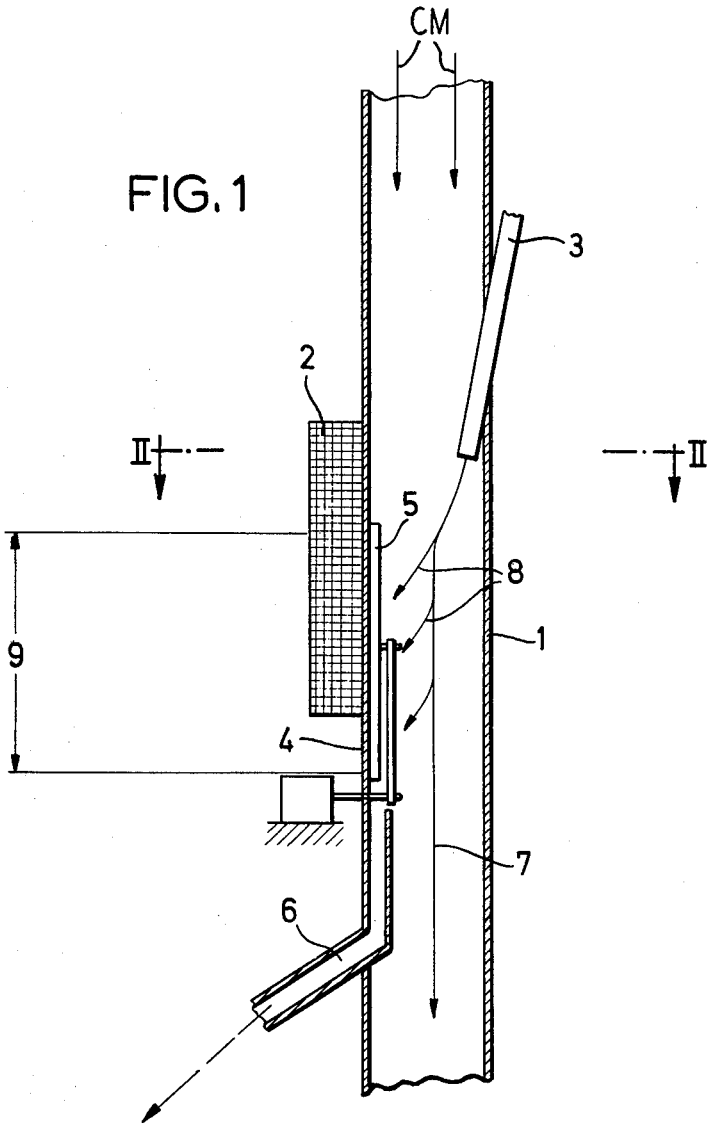
FIG. 1 is a schematic representation of a separation device shown in vertical section.
Figure 2:
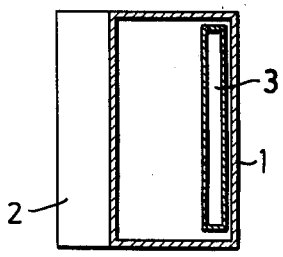
FIG. 2 is a horizontal section of the apparatus of FIG. 1 taken substantially along the line II—II.

Referring to FIGS. 1 and 2, a separation device is illustrated in an exemplary embodiment as comprising an advantageously vertically arranged rectangular carrier medium channel 1 having a channel wall on which is arranged a magnetic coil 2 of a superconducting magnet which is capable of producing a magnetic field of, for example 100,000 Gauss. A carrier medium, symbolically illustrated by the arrows CM, is guided from above downwardly through the channel 1. The carrier medium may be, for example, air or water.

On the side of the wall lying opposite the magnetic coil, in the area of the upper end of the magnetic field, a material charging device opens into the channel, for example in the form of a nozzle 3, whereby between the wall adjacent the magnetic coil and the nozzle opening there is provided a spacing. The nozzle 3 is, in this way as is apparent from FIG. 2, it constructed as a slot-type nozzle which extends parallel to the magnetic coil over the entire width of the channel 1, so that the charging material enters the channel 1 in the form of a thin film or thin veil into the stream of carrier medium CM in the channel 1. To this end, it is of advantage if, for example, upon preparation of a fine granular mineral mixture, the mixture is suspended in a medium corresponding with the carrier medium before the introduction into the channel, and then advantageously is introduced into the channel, so that the static pressure within the stream of material is the same or smaller than the static pressure of the carrier medium in the channel. In this manner expansion of the stream upon entry into the channel is prevented, and it is accordingly prevented that gangue-type materials reach into the vicinity of the precipitation wall. Instead of a slot-type nozzle, also a plurality of nozzles may be provided of round or angular cross-section, arranged adjacent one another.

The fine granular charging material enters approximately into the homogeneous area of the magnetic field traveling synonomously with the stream of carrier medium and in this way attains or reaches the non-homogeneous area of the magnetic field at the lower end with a speed corresponding approximately to the flow speed of this stream of carrier medium, that is, reaches the zone in which the magnetic field has a gradient so that the magnetic forces become effective on the magnetizable particles within the fine granular solid material to effect a drawing of the particles to the precipitation wall 4.

The magnetizable particles deposited on the precipitation wall 4 are removed with the aid of an intermittently, circularly moved wiper 5, and as the case may be, drawn off together with a small part of the stream of the carrier medium from the separation device. The primary mask, that is the non-magnetizable part of the granular material, then follows approximately the path of the arrow 7, while the magnetizable particles following approximately in the course of the thinly delineated arrow 8 reach the precipitation wall 4.

As is apparent without further detailed explanation of the apparatus, with this method it is prevented that the magnetizable particles are hindered on their path to the precipitation wall through the particles of other solid material. It is of advantage if the charging nozzle is at least slightly inclined and introduced in the direction of the carrier medium stream into the channel so that in connection with the inlet speed, the solid particles intersect the field lines in the direction of an increase in the magnetic field, simultaneously, however, on account of the deflection through the stream of carrier medium describe a curved path, so that already in the homogeneous portion of the magnetic field, with respect to the direction of flow of the carrier medium, magnetic forces take effect on the magnetizable particles.

Figure 3:
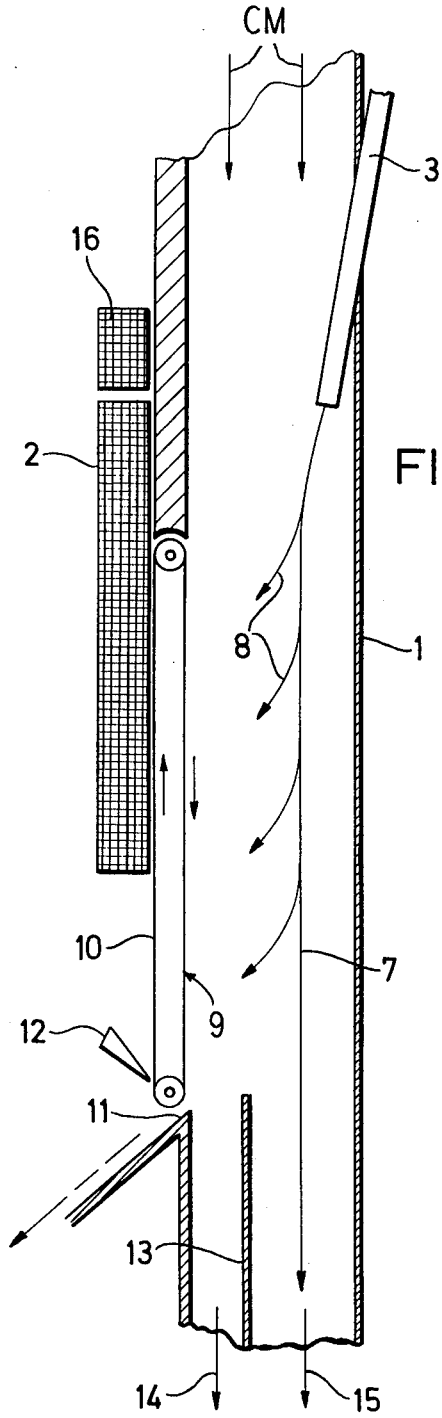
FIG. 3 is a schematic representation of another embodiment of the invention, shown in vertical section.

Referring now to FIG. 3, an embodiment of the invention is illustrated wherein the lower area of the channel wall lying in the separating zone 9, which serves as a precipitation wall, is constructed in the form of a conveyor belt 10 which extends over the entire width of the wall. The conveyor belt 10 traveling on the inner side of the channel downwardly from above, that is, in the direction of flow, on which the magnetizable particles precipitate or deposit themselves, conveys the particles away through a discharge opening 11, whereby through a wiper device 12, shown here in the form of a doctor blade, all particles are removed on the rear side of the conveyor belt. A small part of the stream of the carrier medium is also drawn off.

Independently of the type of the discharge device, it is suitable, according to each type of material to be prepared, if in the lower area of the carrier medium channel, that is downstream of and beneath the separating zone, the channel is divided by means of a separating wall 13, so that the magnetizable particles, particularly in the finest particles, which have not reached the precipitation wall, have, however, accumulated in the flow zone adjacent to the precipitation wall, are drawn off separately from the remaining primary quantity of the stream of carrier medium provided with the gangue material. The separation of the magnetizable particles contained in the partial stream 14 may then take place either through a renewed magnetic division or a mechanical, chemical or thermal separation from the carrier medium.

In order to prevent an influencing of the charging jet by the non-homogeneity of the upper end of the magnetic field, it is furthermore suitable and advantageous if through a correspondingly connected additional coil 16, the non-homogeneity of the upper end of the field is suppressed. In this manner, the separation of magnetizable particles within the charging device which results in, for example, "caking" on the wall of the charging nozzle and which accordingly leads to disturbances in operation, is prevented.

Figure 4:
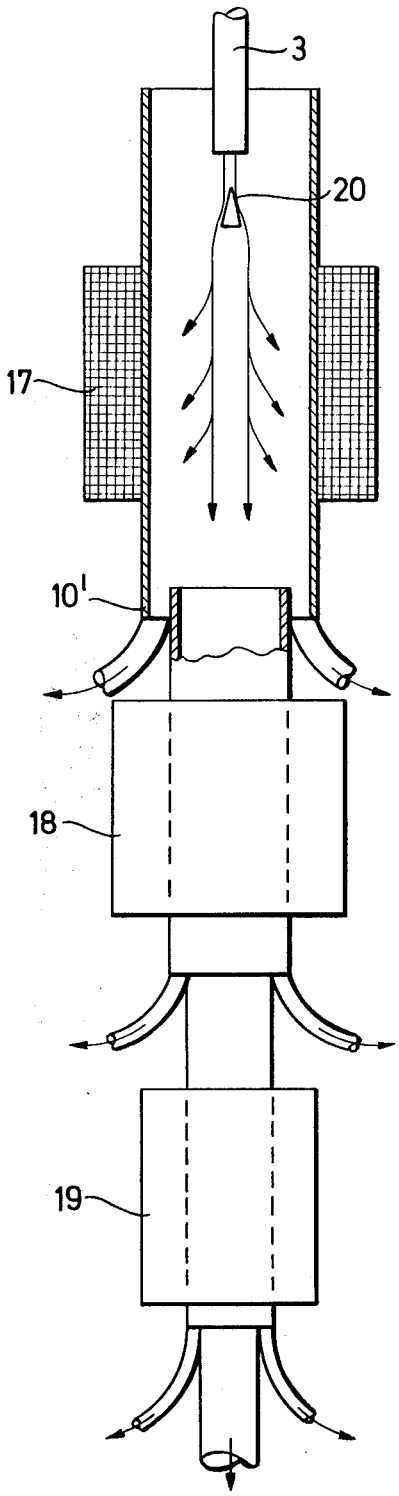
FIG. 4 is a schematic representation of a multi-stage separation device, shown in partial vertical section.

In FIG. 4, a further embodiment is illustrated as exemplary of the invention. In this embodiment, several magnetic coils 17, 18 and 19 are arranged consecutively about a tubular channel, whereby in a suitable manner each consecutive coil produces a stronger magnetic field than the preceding coil. Beneath each coil, by means of a discharge device 10 indicated diagrammatically on the drawing, the magnetizable material separated off in the particular separating zone is removed from the stream of carrier medium, while the main stream is introduced into the next magnetic field. Separation may be attained by any of the aforementioned techniques.

The charging device discharges coaxially into the channel, whereby advantageously below the opening of the nozzle 3 a deflector 20 is arranged. According to the cross-sectional size of the channel, in each case, it is suitable, instead of a deflector, to provide a displacement member which extends along the axis of the channel, so that the channel receives a circular cross section of flow.

The apparatus described above for separating magnetizable particles are particularly useful in the following instances of application:

1. In the preparation of magnetizable ores, particularly of weakly magnetizable ores, for the separation of the ore from the mineral gangue;
2. For the removal of iron-containing magnetizable accompanying materials from ore concentrate of a non-ferrous ore;
3. For the removal of iron-containing magnetizable materials from, for example, kaolin, In the second and third instances set forth above, the magnetizable portions in each case reveal the impurity, while the primary quantity of the solid reveals the product of value to be recovered; and
4. The removal of magnetizable impurities from liquid, whereby also particles in the colloidal area may be removed from a liquid due to the high magnetic field intensities which are employed.

Although we have described our invention by reference to particular illustrative embodiments thereof, many changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

We claim:

1. Apparatus for separating magnetizable particles from a flowing stream of material, comprising:

a channel including a plurality of vertical walls for directing the stream of material along a predetermined path, one wall of said plurality of walls including a vertically travelling conveyor belt, said channel including an inlet for receiving a stream of carrier medium;

means for introducing a carrier medium into said inlet of said channel;

at least one magnet system outside said channel adjacent said one wall creating a magnetic field within said channel in a portion of the path having a field strength of at least 15,000 Gauss and a magnetic gradient directed across the path to define a separating zone;

injecting means for injecting a charging material, including magnetizable particles to be separated therefrom, into the stream of carrier medium at a point within said channel oppositely spaced from said one wall and downstream of said inlet, the magnetizable particles being drawn toward said one wall by the force of said magnetic field;

means for removing at least a part of the carrier medium, together with non-drawn material, downstream of the sparating zone and spaced from said one wall; and means for removing from said one wall those particles which adhere to said one wall including a member for doctoring particles from said conveyor belt.

* * * * *